United States Patent [19]

Maninfior

[11] Patent Number: 5,054,255

[45] Date of Patent: Oct. 8, 1991

[54] WALL PANEL CONSTRUCTION AND CONNECTION SYSTEM

[75] Inventor: Herbert E. Maninfior, Chehalis, Wash.

[73] Assignee: Herbert Maninfior Design/Engineering, Winlock, Wash.

[21] Appl. No.: 427,729

[22] Filed: Oct. 27, 1989

[51] Int. Cl.[5] ..... E04H 1/00

[52] U.S. Cl. ..... 52/239; 52/582; 52/584

[58] Field of Search ..... 52/584, 221, 582, 239

[56] References Cited

U.S. PATENT DOCUMENTS

| | | | |
|---|---|---|---|
| 3,280,522 | 10/1966 | Palfey et al,. | 52/584 X |
| 4,060,294 | 11/1977 | Haworth et al. | 52/221 X |
| 4,417,430 | 11/1983 | Loikitz | 52/584 |
| 4,881,349 | 11/1989 | Brown et al. | 52/584 X |

*Primary Examiner*—David A. Scherbel
*Assistant Examiner*—Linda J. Watson
*Attorney, Agent, or Firm*—Christensen, O'Connor, Johnson & Kindness

[57] ABSTRACT

The wall panels (14,16,18) of a wall panel system (12) are constructed with perimeter frames (22,24,26) each composed of tubular vertical edge members (40) interconnected with the ends of horizontal top members (42) and horizontal bottom members (46) by corner connectors (44). The corner connectors (44) have legs (84) that engage within the hollow ends of the frame members (40,42,46). A plurality of shear fins (86) extend transversely from the legs (84) with the transverse profile defined by the fins being greater than the interior envelope of the frame members so that as the corner connectors (44) are forged into the interiors of the frame members, the outer edges of the fins (86) are sheared so that the fins fit very snugly within the interiors of the frame members. The panels (14,16,18) are interconnected together by cam latches (126) composed of a pair of opposing spaced apart hooks (**134*a*, 134*b*) that engage with mating catches (128) mounted on the opposing edge of the adjacent wall panel. The cam latches have a pair of spaced apart caming surfaces (136) extending longitudinally along the cam latch to terminate at spaced apart stops (138*a*, 138*b*), with one of the stops being engagable with a mating catch (128) when the wall panels are connected together by sliding the wall panels in one relative direction to each other and the catch (128) being engaged with the other stop of the cam latch (126**) when the wall panels are engaged together by relative sliding movement in the opposite direction.

40 Claims, 11 Drawing Sheets

WALL PANEL CONSTRUCTION AND CONNECTION SYSTEM

TECHNICAL FIELD

The present invention relates to wall panel construction and connection systems, and in particular to wall partition systems which may be detachably assembled in various configurations to divide an open office into desired work areas.

BACKGROUND OF THE INVENTION

In modern offices it is common to divide a large, open area into individual or group work spaces through the use of portable panels of various heights. The portable panels cost less than permanent floor to ceiling walls and usually can be disassembled and used again to reconfigure the work space as needs change without having to undertake the expense of knocking down and reconstructing permanent walls. The portable panels usually are constructed with flat or curved panel members composed of acoustical material or glass surrounded by a perimeter frame of metal or wood. Typically, the individual panels are connected together in edge to edge relationship to form a continuous wall or a corner joint.

In one common connection system, one side edge of a panel is constructed with male connection members which engage within female connection portions formed in the mating side edge of the adjacent panel. U.S. Pat. Nos. 2,732,044, 4,223,500, and 4,360,553 disclose various male/female connection arrangements. A very significant drawback of this type of panel connection system is that in order to be interconnected together, the panels must always be disposed in the same relative relationship to each other, i.e., they cannot be rotated about a vertical axis and then reconnected to adjacent panels. This limits the flexibility of the panels, especially when desiring to reconfigure work spaces.

In another type of wall panel construction, mating clips must be mounted on the side edges of the wall panels using screws or other types of fasteners. This significantly increases the time required to install the panels. An example of this type of wall panel construction is disclosed by U.S. Pat. No. 4,158,936.

In a further type of wall panel connection system, a separate column standard is interposed between the facing side edges of adjacent wall panels. Male hook members are mounted on the edges of the side panels to engage with the column standard. An example of this type of wall panel construction is disclosed by U.S. Pat. No. 4,716,692. The column standards constitute additional components that must be fabricated and inventoried. A further drawback of this particular type of wall panel construction, and also of each of the foregoing types of wall panel constructions, is that adjacent wall panels cannot be flipped about a horizontal axis and then reconnected together, thus restricting the flexibility of the panels.

Most modern wall panel systems are, in theory, designed to support shelves, countertops, desktops and other work surfaces which are mounted on the wall panels in cantilever fashion. Thus, the panels must be capable of safely carrying significant loads and also must not flex or bow during use. With the exception of the wall system disclosed in the '044 patent, none of the above referenced wall systems employ any specific arrangement for insuring that adjacent wall panels are securely connected to the other to form a rigid construction. In the '044 patent, bolts must be installed to lock adjacent wall panels in interconnected relationship. Use of such bolts significantly increases the time needed to install the wall panels and also the time required to dissemble the wall panels when desiring to reconfigure the workspace.

As noted above, the individual wall panels are usually constructed with a perimeter frame which extends around the sides, top and bottom edges of acoustical or glass panel members. Typically, the perimeter frame is composed of tubular members interconnected at their ends by corner connectors that engage within the hollow interiors of the tubular members. The corner connectors often include leg sections which are inserted into the adjacent ends of the frame tubes. In order to achieve satisfactory structural integrity, it is very important that the corner connectors snugly fit within the tubes and also remain locked in place. In an effort to meet these requirements, typical corner connectors include flexible fingers or barbs that extend outwardly from the connector legs in the direction away from the free ends of the corner connector so that when the corner connectors are inserted into the hollow ends of the frame tubes, the fingers or barbs flex downwardly to enable the corner connectors to be assembled. However, once assembled, the outer edges of the barbs bear tightly against or even perhaps "bite into," the inside surface of the frame tubes to prevent the corner connectors from dissembling from the frame tubes. Examples of this type of construction are disclosed by U.S. Pat. Nos. 4,105,348 and 4,683,634. A common drawback of this type of corner connector is that the fingers or barbs are flexible and thus do not adequately restrain angular movement between the corner connectors and the frame tubes. Also, the corner connectors cannot be dissembled from the frame tubes without damaging or even destroying the connectors and/or the frame tubes when desiring to modify the wall panel, for instance, to change the size of the panel.

SUMMARY OF THE INVENTION

The drawbacks of the foregoing types of partition wall panels are addressed by the present invention which provides a connection system especially adapted for partition wall panels. The connection system has at least one cam latch and catch set mounted on a side edge of each panel. The cam latch of the cam latch and catch set of a first panel is engagable with the catch of the cam latch and catch set of an adjacent second panel, and correspondingly, the catch of the cam latch and catch set of the first panel is engagable with the cam latch of the cam latch and catch set of the second panel. The cam latch and catch of each set are disposed in side-by-side relationship to each other and movable relative to each other along the side edge of the panel.

The cam latch of each set has a pair of spaced apart caming surfaces extending longitudinally along the cam to terminate at longitudinally spaced apart stops formed in the cam latch. One of the caming surfaces of each latch is engagable with a mating catch mounted on the opposite panel so as to engage the catch against a corresponding stop when the mating cam latch and catch are fully engaged with each other. The longitudinal distance separating the stops of the cam latch correspond to the longitudinal distance the cam latch and mating catch are permitted to shift relative to each other. By this construction, the first partition wall panel may be interconnected with the second partition wall panel by lowering either of the two aligned partition wall panels relative to each other. If the first panel is lowered into engagement with the second panel, the catch of the cam latch and catch of each sets abuts with one of the stops of the mating cam latch, but if the second panel is lowered into engagement with the first panel, so that the direction of relative movement between the panels is reversed, the catch and mating cam latch shift relative to each other so that the catch is engaged with the opposite stop of the cam latch.

In a more specific aspect of the present invention, the cam latch and catch sets are mounted on the panels to permit the cam latches and mating catches to slide relative to each other a fixed distance along the panel members. Either the catch or the cam latch is mounted stationarily and the other of the cam latch or catch is slidably mounted for movement along the partition panel edge portion. At the location of maximum relative travel of the cam latch and mating catch in a first direction, the catch is engaged with one of the stops of the cam latch, and at the location of maximum relative travel of the cam latch and catch in the opposite direction, the catch is engaged with the second, opposite stop of the cam latch.

In accordance with a further aspect of the present invention, the cam latch and mating catch, are adapted to pivot relative to each other to permit the catch to engage with one of the two cam stops depending upon the direction of relative movement between the wall panels when being interconnected together, i.e., whether the first wall panel is being lowered relative to the second wall panel or vice versa.

In accordance with another more specific aspect of the present invention, compression buffers composed of resilient, compressible material are mounted on the edge portions of the wall panels so that when adjacent wall panels are interconnected together, the compression buffer imposes a force tending to force the wall panels away from each other in opposition to the engaged cam latch and mating catch.

In an additional aspect of the present invention, the partition panels are composed of a frame which extends around the perimeter of an acoustical or glazed panel member. The perimeter frame is composed of tubular members interconnected at their ends by corner connectors. The corner connectors include a central portion and leg members extending outwardly therefrom to engage within the hollow ends of the frame members. A plurality of shearable members project transversely outwardly from the corner connector leg members to terminate at outermost portions that define a profile in the transverse direction of the leg members of the size somewhat larger than the transverse profile of the hollow interior of the end portions of the panel frame members. As a result, when the leg members of the corner connectors are driven into the hollow interior of the corresponding frame members, the outermost portions of the shearable members are sheared so that the leg members are very snugly engaged within the panel frame members.

BRIEF DESCRIPTION OF THE DRAWINGS

The details of typical embodiments of the present invention will be described in connection with the accompanying drawings, in which.

DETAILED DESCRIPTION OF THE INVENTION

Figure 1:
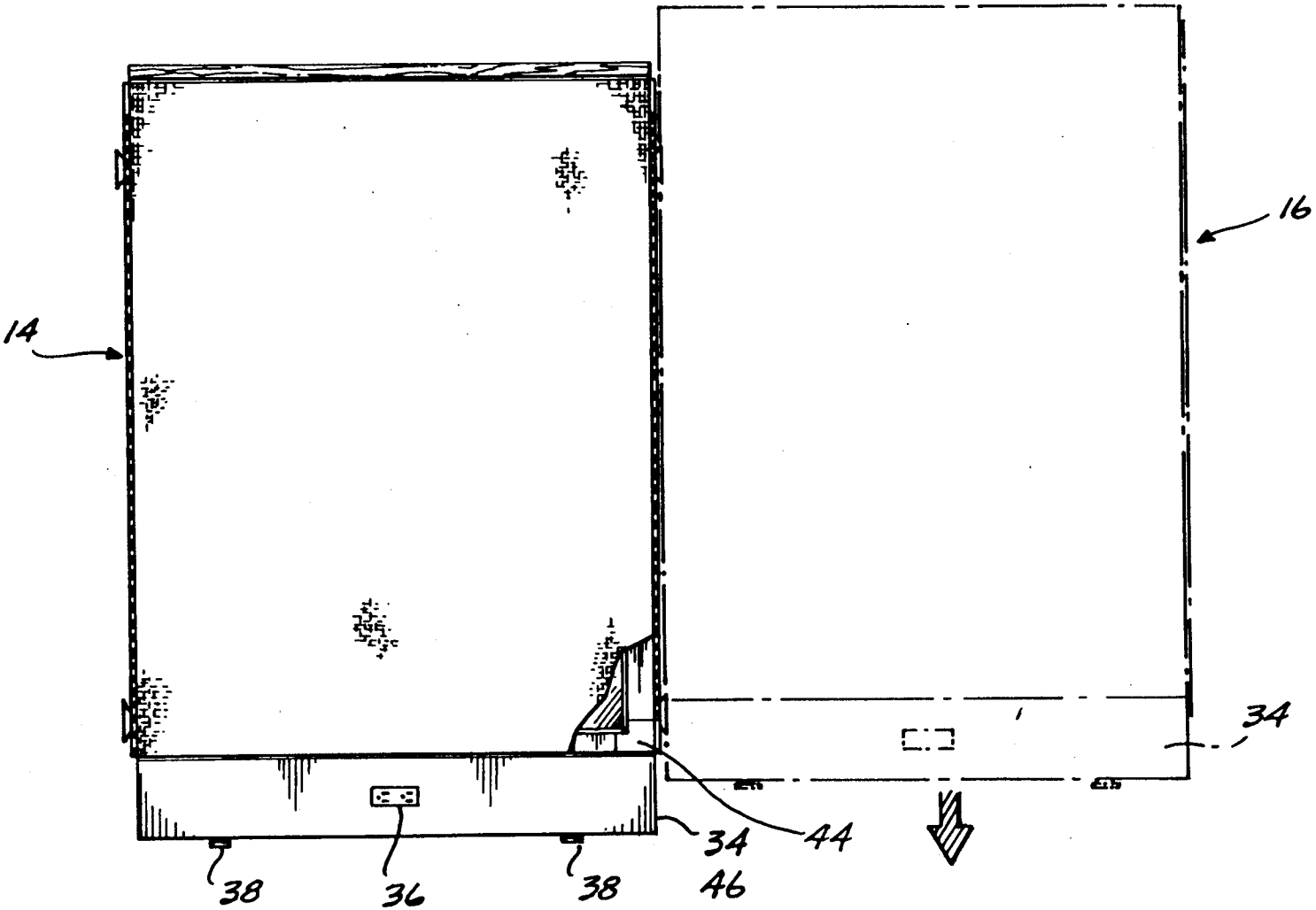
FIG. 1 is a front elevational view of two side-by-side panels of a wall panel system constructed in accordance with the present invention.
Figure 2:
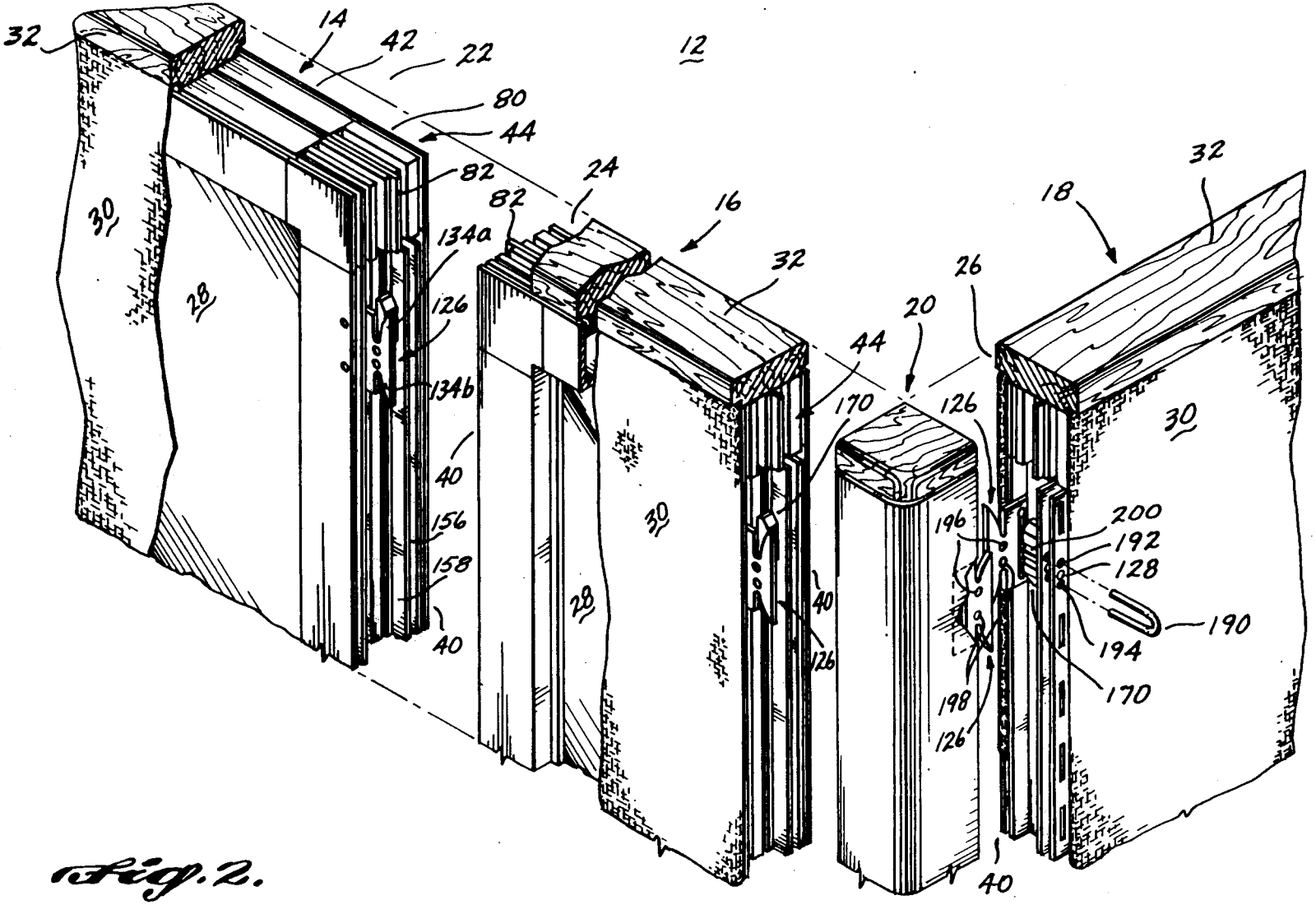
FIG. 2 is a fragmentary isometric view of the wall panel system of the present invention with portions broken away for clarity.

Initially referring to FIGS. 1 and 2, a wall panel system 12 constructed in accordance with the present invention is illustrated as including two side-by-side panels 14 and 16 and a transverse panel 18 innerconnectible with panel 16 through the use of a corner connection post 20. Each of the panels is constructed with a perimeter frame 22, 24, and 26, respectively, which extends around the edges of a central acoustical panel section 28. The exterior faces of the panels are covered with a desired covering material, such as fabric 30. It is to be understood that any type of appropriate covering may be used in place of the fabric 30, for instance, wood veneer. A trim strip 32 extends over the upper edge of the panels to provide a finished appearance. The trim strip may be composed of wood or other appropriate material. A bottom raceway 34 is shown as extending along the bottoms of the panels beneath the perimeter frame to support the panels on the floor. The raceway is constructed with a hollow interior through which electrical cables and other types lines or cables may be routed. Electrical service outlets 36 are mounted on the raceway to provide electrical power to locations along the panels. It is to be understood that although it may be desirable to utilize a raceway, such as raceway 34, the panels of the present invention may be constructed without raceways. Adjustable height feet 38 extend downwardly from the raceway 34 to bare against the floor. If no raceway is used, the feet 38 may adapted to extend downwardly from the bottom of the panel. The standout of the feet beneath the raceway or the panel (if not raceway is employed) may be altered to adjust the height of the wall panel and level the wall panel as necessary.

Figure 10:
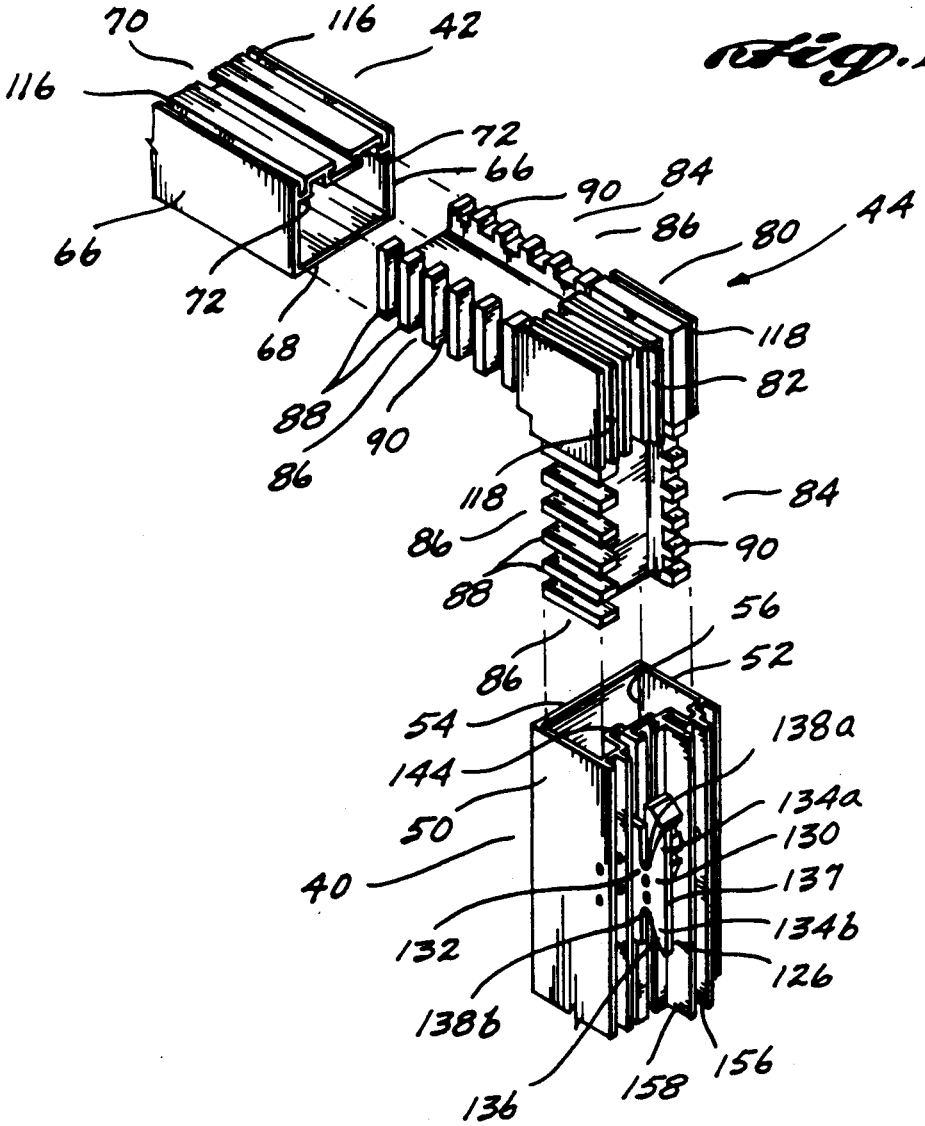
FIG. 10 is a fragmentary isometric view of the present invention specifically illustrating a corner connector used to interconnect the ends of the frame members of a panel.

Next describing the construction of the wall panels 14, 16 and 18 in greater detail, the perimeter frames 22, 24, and 26, respectively, of these panels are composed of vertical edge members 40 interconnected with the ends of a horizontal top member 42 by corner connectors 44, FIGS. 2 and 10. The lower ends of the vertical edge members 40 are interconnected with the ends of horizontal bottom members 46 by the corner connectors 44, FIG. 1. Preferably, the frame vertical members 40, top members 42, and bottom members 46 are of generally tubular construction having a unique generally rectangular cross-sectional shape, as discussed more fully below.

Figure 4:
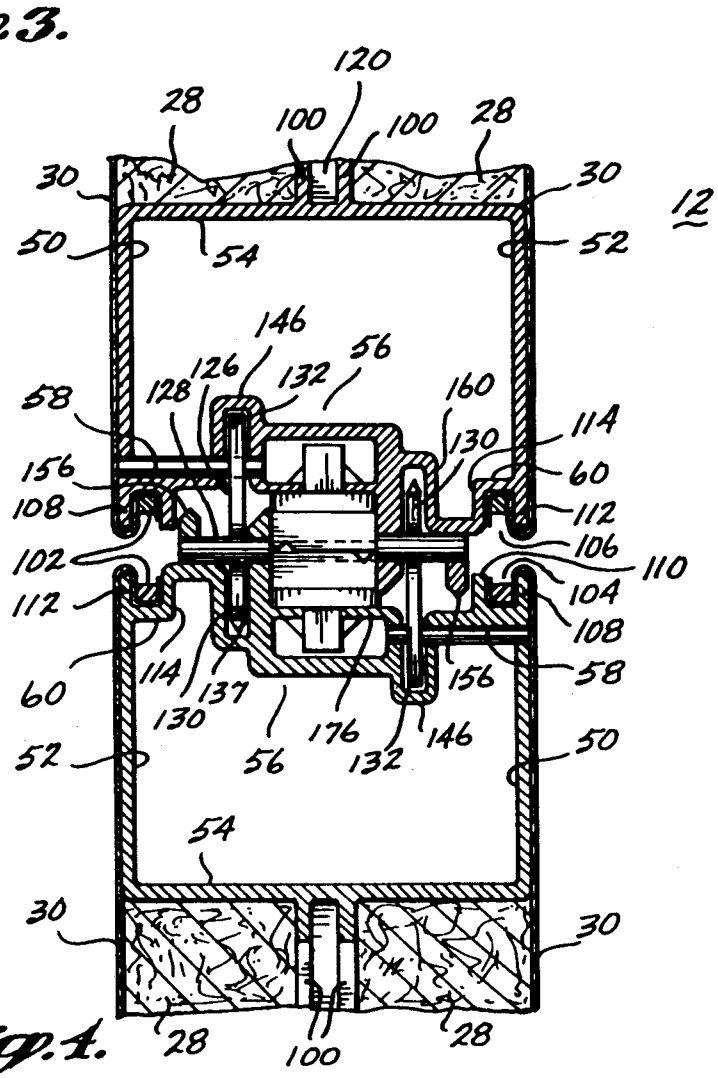
FIG. 4 is a cross-sectional view similar to FIG. 3, but showing the wall panels interconnected together.
Figure 3:
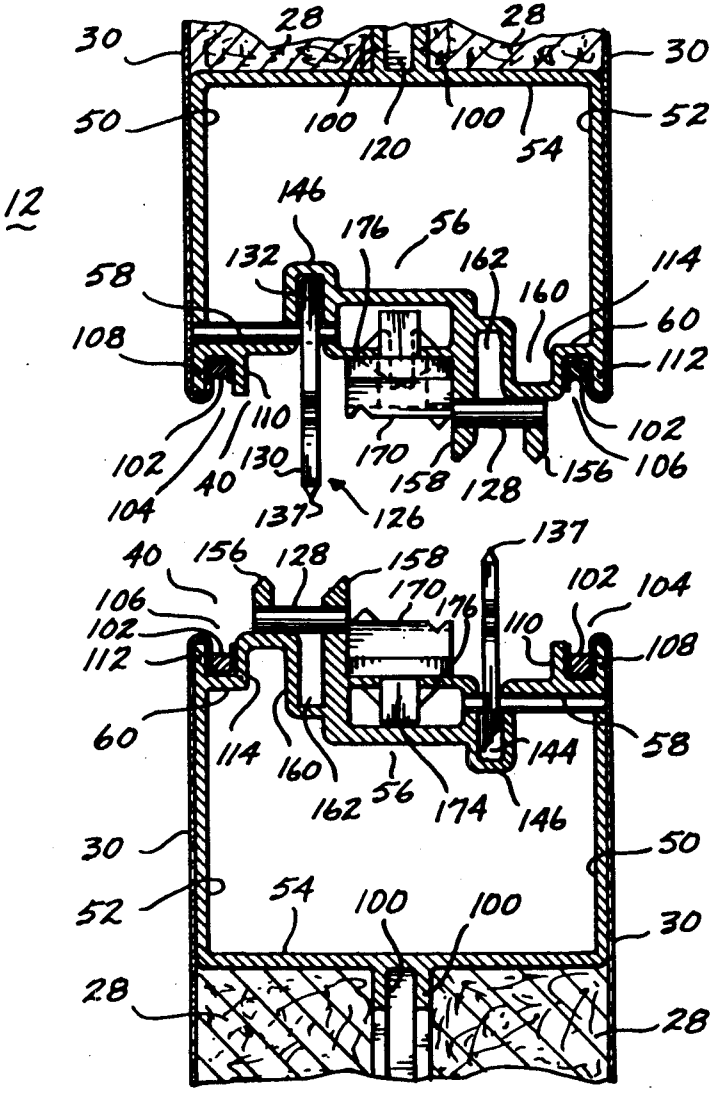
FIG. 3 is a fragmentary cross-sectional view of the edge portions of two wall panels constructed according to the present invention.

First considering the frame vertical members, as illustrated in FIGS. 3, 4, and 10, such members are composed of substantially planar side walls 50 and 52, a substantially flat interior or rear wall 54 and a contoured exterior or forward wall 56. The forward wall 56 includes transverse, substantially flat corner portions 58 and 60 at the intersection with the side walls 50 and 52, respectively.

In the present application, with respect to a wall panel, the "forward" direction shall refer to the horizontal direction away from the side edge of a panel. For instance, in FIG. 5, with respect to panel 16, the forward direction is depicted by the arrow 45. The "rearward" direction for the panel 16 is in the direction opposite to the arrow 45. Of course, for the opposite side edge of panel 16, the "forward" and "rearward" directions would be reversed from the foregoing. Also, the "inward" direction shall designate the direction transversely toward the center of the thickness of the panel, and the "outward" direction shall designate the direction transversely outwardly from the exterior faces of the panel.

In a manner similar to the vertical frame members 40, the frame top member 42 is composed of substantially planar side walls 66, a substantially planar bottom wall 68 and a contoured top wall 70. At its interconnection with the side walls 66, the top wall 70 includes flat corner portions 72 which preferably are spaced from the bottom wall 68 a distance corresponding to the distance separating the corner portions 58 and 60 of the frame vertical member 40 from the rearward wall 54 of the frame vertical member. Also, ideally the distance separating the side walls 66 of the frame top member 42 is essentially the same as the distance separating the side walls 50 and 52 of the frame vertical member 40. In addition, ideally the interior of the frame bottom member 46 is essentially identical in cross-sectional shape with the frame top member 42. As a result of this corresponding construction of the interiors of the frame vertical members 40, top member 42 and bottom member 46, such frame members may be interconnected by a common corner connector 44.

Referring specifically to FIGS. 2 and 10, the corner connector 44 includes a central portion 80 having an exterior configuration generally corresponding to the exterior configuration of the sidewalls 50 and 52 and forward wall 56 of the vertical frame members 40. In this regard, the exterior sides of the central portion 80 are substantially coplanar with the side walls 50 and 52 of the vertical frame members 40 as well as the side walls 66 of the top frame member 42. However, in a manner dissimilar to the configuration of the forward wall 56 of the vertical frame members 40, a central flange 82 extends outwardly beyond the envelope of the central portion 80 of the connector 44, and in a manner dissimilar to the configuration of the top wall 70 of the top frame member 42, the central flange 82 also extends upwardly above the envelope of the central portion of the connector 44. The flange 82 functions as a light barrier to prevent light from passing between adjacent corner connectors when the wall panels of the present invention are assembled together.

Two legs 84 extend outwardly from the central portion 80 of the corner connector in directions transversely to each other. The legs 84 include a plurality of fins 86 extending transversely to the length of the legs. The fins 86 are spaced apart from each other along the length of the legs 84. The fins have side edge portions 88 corresponding to the side walls 66 of the frame top member 42 and the side walls 50 and 52 of the frame vertical members 40. The fins also include end edges 90 corresponding to the bottom wall 68 and the top wall upper corner portions 72 of the frame top member 42 as well as corresponding to the rear wall 54 and the corner portions 58 and 60 of the forward wall 56 of the vertical frame members 40. The transverse profile of the connector legs 84 as defined by the exterior edges 88 and 90 of the fins 86 is somewhat larger than the interior envelope of the frame members 40, 42, and 46. Consequently, in order to interconnect the frame members 40, 42, and 46, the legs 84 of the corner connectors 44 must be forged into the interiors of the frame members. As this occurs, the outer edges 88 and 90 of the fins 86 are sheared so that the fins 86 very snugly engage within the interiors of the frame members. The material removed from the fin edges 88 and 90 is free to drop or otherwise fall within the gaps existing between the adjacent fins. As a result, this removed material is not lodged between the fins and the walls of the frame members which could then prevent the connector legs 84 from engaging fully within the hollow end portions of the frame members. When the corner connector 80 is fully inserted within the frame members, the ends of the frame members abut against the adjacent sides of the central portion of the corner connector. It will be appreciated that the corner connectors serve to enhance the structural integrity and rigidity of the perimeter frames 22, 24 and 26.

Describing in greater detail the construction of the frame vertical members 40, as shown most clearly in FIGS. 3, 4, and 10, the frame vertical members include a pair of parallel ribs 100 extending transversely inwardly from the rear wall 54, i.e., the direction away from the exterior wall 56. The ribs 100 serve as abutments for the sound insulation panels 28 which are encircled by the perimeter frames 22, 24, and 26. The acoustical panels 28 are held against the ribs 100 primarily by sizing the panels slightly larger than the interior openings defined by the perimeter frames so as to create an interference fit therebetween, and also secondarily by the fabric 30 that covers the faces of the panels 14, 16, and 18. A layer of foil may be laminated to the back of the acoustical panels 28 to help reduce the transmission of sound through the panels. The gap 120 extending between the ribs 100 may be left empty or occupied by a desirable material, such as hard board, for increasing the rigidity of the panels 14, 16, and 18.

The fabric 30 is held in taut condition over the wall panels by locking strips 102 which anchor the marginal portions of the covering 30 within channels 104 and 106 associated with the side walls 50 and 52, respectively, of the vertical frame members 40. The channel 104 is formed by the forward edge portion 108 of the side wall 50 (that extends forwardly of the shoulder portion 58) together with the shoulder portion 58 and a flange 110 extending parallel to and spaced inwardly from the side wall forward edge portion 108. In a similar manner, the channel 106 is formed by the forward or leading edge portion 112 of the side wall 52 (that extends forwardly of the shoulder 60) together with the shoulder 60 and section 114 of the forward wall 56 which section extends parallel to the side wall leading edge 112.

As shown in FIG. 10, channels 116 are formed in the top wall 70 of the top frame members 42 in registry with the channels 104 and 106. Ideally, the bottom frame member is constructed essentially identically to the top frame member and thus also includes channels 116 extending therealong. Channels 118 are also formed in the corner connector central portion 80 in registry with the channels 104 and 106 of the vertical frame members 40 and the channels 116 of the top frame member 42. As such, the entire marginal portion of the fabric covering 30 may be anchored within the channels 104, 106, 116 and 118 that cooperatively extend around the entire perimeter frame. In addition, a continuous length of the locking strip 102 may be employed to extend around the entire perimeter of the wall panels thereby facilitating the assembly of the wall panels. Ideally, the locking strips 102 are composed of a resilient deformable material which may be snugly forced into the channels 104, 106, 116, and 118 by any convenient method and once installed, remain securely in place.

The wall panels 14, 16, and 18 are interconnected by a unique hermaproditic coupling system of the present invention which permits the wall panels to be very quickly but securely coupled together without having to install clips, screws or other types of fasteners or other hardware members and without the need for any drilling or other machining operations. Moreover, the panels 14, 16, and 18 may individually or collectively be reversed, i.e., pivoted about vertical axis, and then conveniently recoupled together without having to make any modifications to the panels and without having to remove and then reinstalling hardware members, clips, or other fastening elements. To this end, the hermaproditic coupling system of the present invention includes sets of cam latches 126 and catches in the form of cross pins 128 mounted on the forward walls 56 of the vertical frame members 40 in the manner described more fully hereafter. The cam latch 126 and cross pin 128 of each set are disposed in side-by-side relationship to each other, as shown in FIGS. 3 and 4 to engage with mating cross pins and cam latches, respectively, mounted on the abutting frame vertical member 40 of the adjacent wall panel.

As perhaps most clearly shown in FIGS. 3–8, the cam latch 126 is generally planar and includes a forwardly extending hook section 130 and a rearwardly disposed slide section 132. The hook section 130 is composed of a pair of opposing, spaced apart hooks **134*a* and 134*b* defined by contoured caming surfaces 136 that extend from the ends of the leading edge 137 of the hook section toward the longitudinal center of the cam latch and also simultaneously rearward toward the slide section 132 of the cam latch (thus in the direction away from the panel that is adjacent to the panel on which the cam latch is mounted). The caming surfaces 136 terminate at stops or seats 138*a* and 138*b* which in effect constitute the bottom of slots 140*a* and 140*b* defined by the caming surfaces 136 and the forward edges 142 of the slide section 132** of the cam latch.

Figure 5:
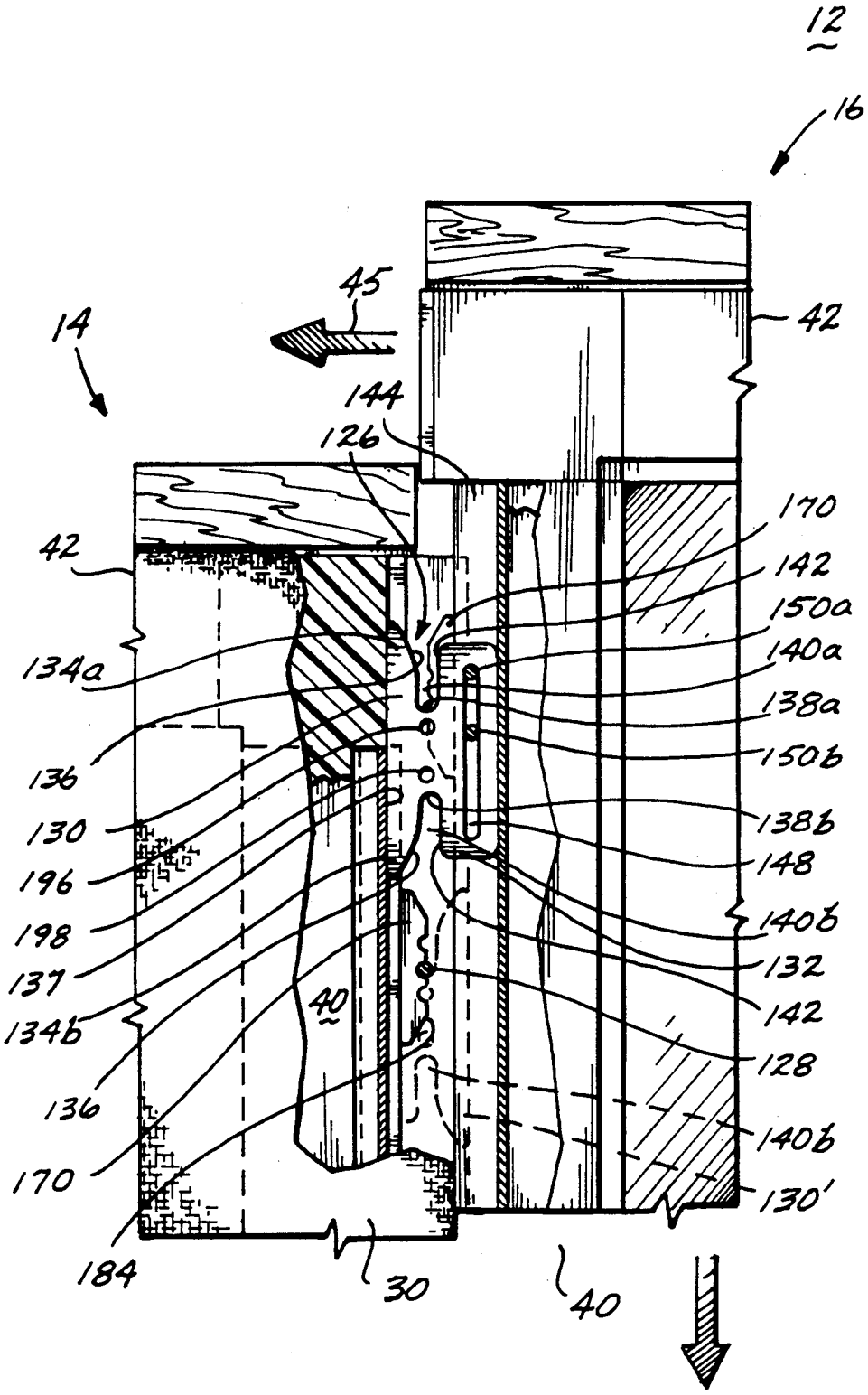
FIG. 5 is a fragmentary side elevational view of two wall panels constructed in accordance with the present invention prior to the interconnection of the two panels.
Figure 6:
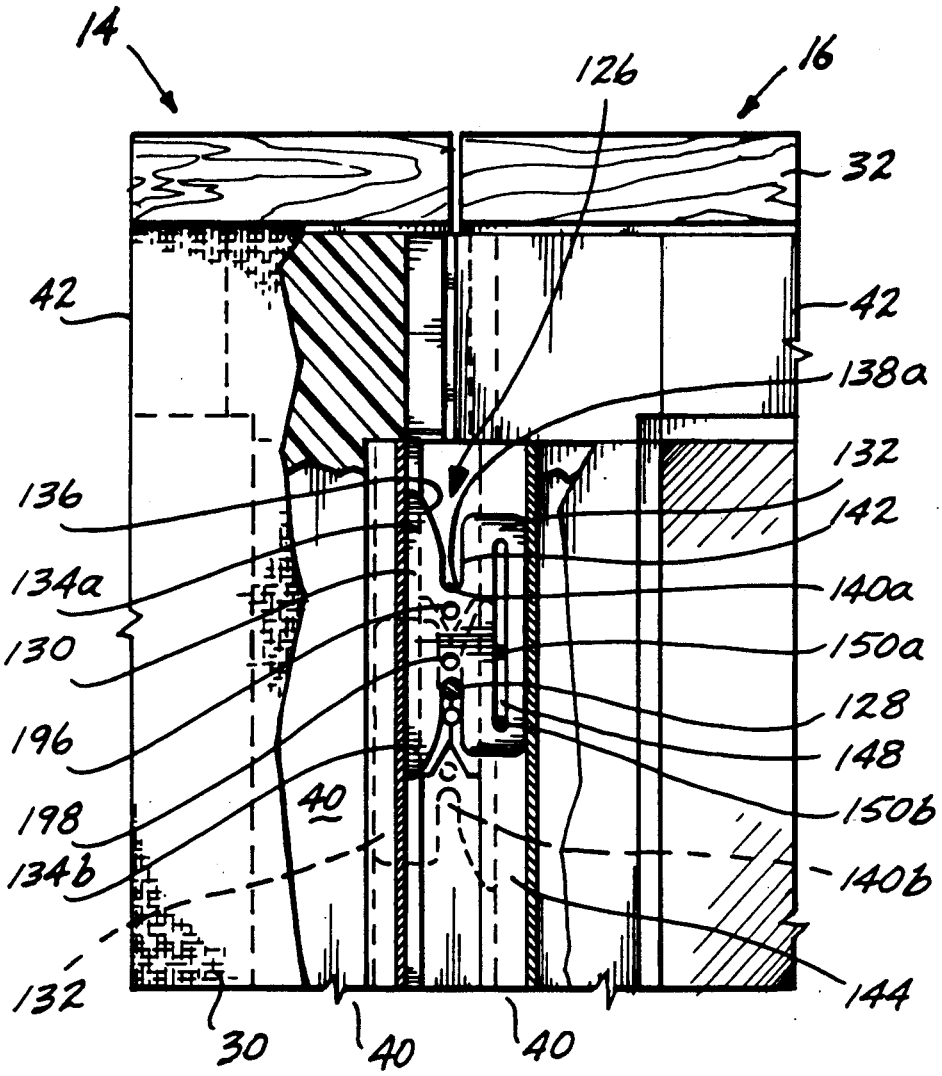
FIG. 6 is a view similar to FIG. 5, but with the two wall panels shown in interconnected condition.

As shown in FIGS. 5–8 and 10, the slide section 132 of the cam latch 136 is of a generally rectangular shape extending longitudinally of the cam latch. The slide section 132 is disposed within a close fitting channel 144 formed by a U-shaped section 146 of the forward wall 56 of the upright frame member 40, FIGS. 3 and 4. To accommodate the rearward intrusion of the slide section 132, the U-shaped section 146 extends rearwardly into the interior of the vertical frame member 40 further than any other portion of the forward wall 56. An oblong slot 148 extends lengthwise along the cam latch slide section 132, and a pair of cross pins **150*a* and 150*b* extend transversely through the slot 148 to retain the slide section 132 within the channel 144 while permitting the cam latch to move (slide) in the longitudinal direction, i.e., vertically within the channel 144. As will be appreciated, at the maximum travel of the cam latch 126, one of the cross pins 150*a* and 150*b* abuts against the adjacent end of the slide section slot 148. The distance that the cam latch 126 is allowed to slide within the channel 144 corresponds to the distance separating the stops 138*a* and 138*b* of the cam latch. Thus, when the cross pin 150*a* abuts against the end of slot 148, the stop 138*a* is in alignment with a mating cross pin 128 (FIG. 8), whereas when the cam latch 126 is slid to its opposing extreme position so that the cross pin 150*b* abuts against its corresponding end of the slot 148, the stop 138*b* is in alignment with the mating cross pin 128 (FIG. 6**).

Figure 7:
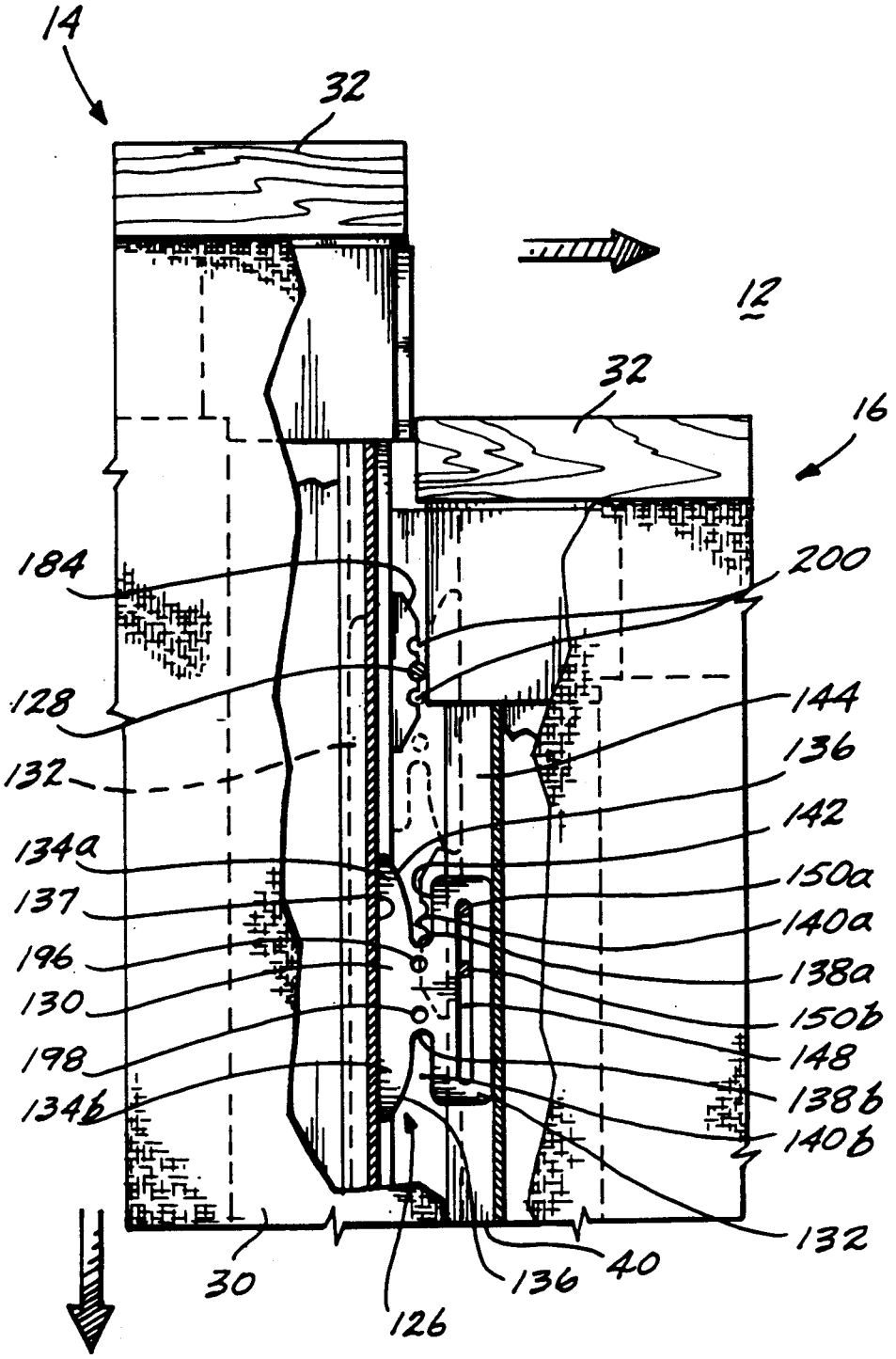
FIG. 7 is a fragmentary side elevational view of two wall panels constructed in accordance with the present invention prior to the interconnection of the two panels.
Figure 8:
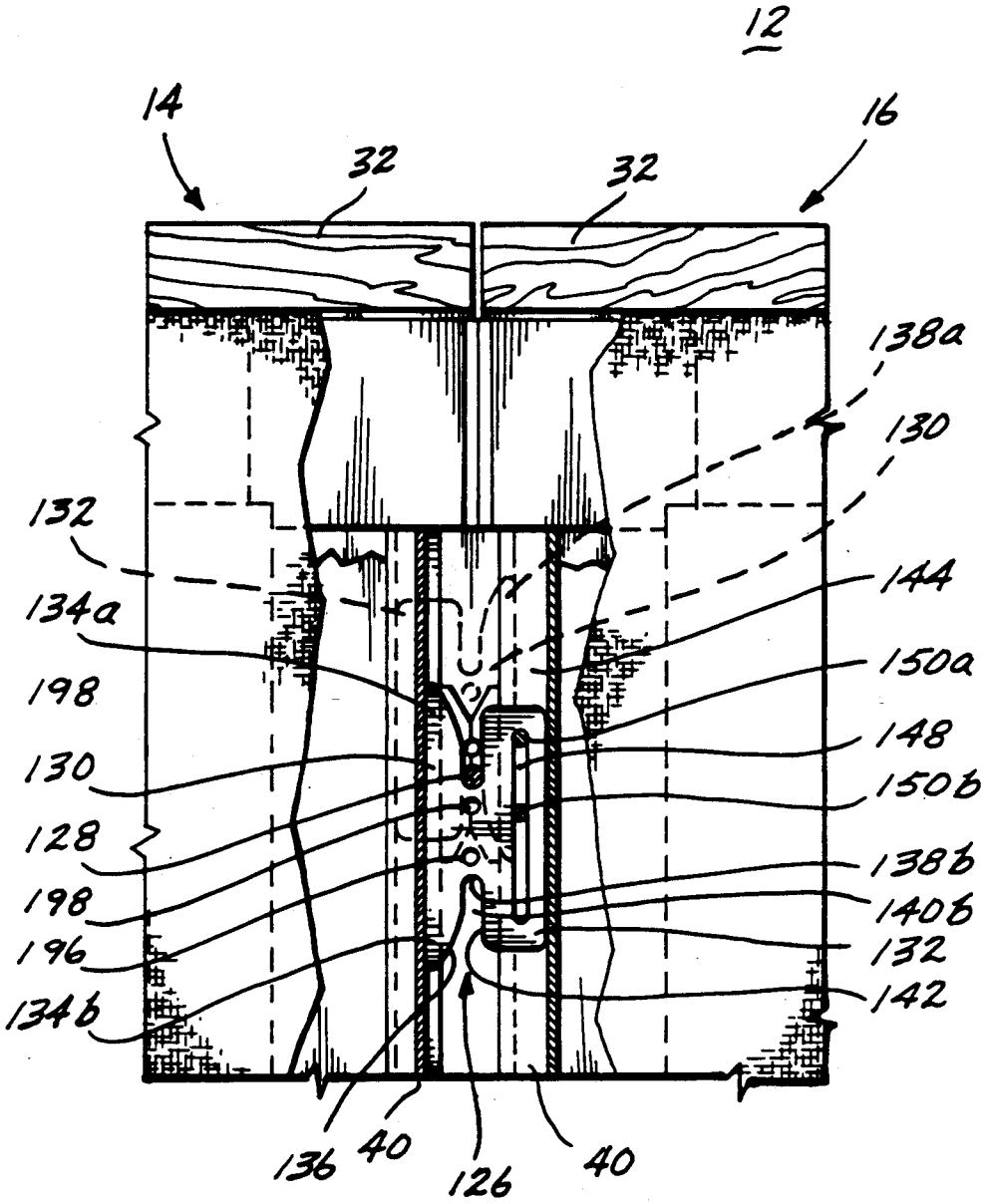
FIG. 8 is a view similar to FIG. 7, but with the two wall panels shown in interconnected condition.

The catch portion of the novel hermaproditic coupling system of the present invention is illustrated in FIGS. 3–8 as composed of a cross pin 128 extending between spaced, parallel flanges 156 and 158 extending forwardly from the contoured frame member wall 56. As shown in FIGS. 2 and 10, the flanges 156 and 158 extend the entire length (height) of the frame members 40. Close fitting, aligned cross holes are formed in the flanges 156 and 158 for reception of the cross pin 128. The cross pin 128 is in alignment in the fore and aft direction with the slots **140*a* and 140*b* of the cam latches 126. The flange 158 cooperates with a section 160 of the forward wall 56 to define a U-shaped slot 162 extending along the height of the frame member 40, as shown in FIGS. 3 and 4. The slot 162 is of a width to closely receive the hook section 130 of a matching cam latch, with the depth of slot being sufficient to provide adequate clearance for the front or leading edge 137 of the hook section. To facilitate engagement of the cam latch 126 within the slot 162, the cam latch leading edge 137 is beveled. Also, the leading edges of the flanges 156 and 158 are beveled. As shown in FIGS. 4, 6 and 8, when the vertical frame members 40 of adjacent the wall panels are coupled together so that the cam latches 126 are engaged with mating cross pins 128, the flanges 156 associated with the cross pins 128 overlap the adjacent flanges 110** of the vertical member of the adjacent panel.

When coupled together, the wall panels of the present invention are held tightly together by a loading system that imparts a load on the adjacent frame vertical members 40 in the direction tending to force the frame vertical members apart from each other but for the engagement of the cam latches 126 and mating cross pins 128. The loading system includes elongated blocks or buffers 170 of compressible, resilient material having a low coefficient of friction. The buffers 170 are positioned between sets of cam latches 126 and corresponding cross pins 128, FIGS. 3–9. The compression buffers 170, oriented longitudinally relative to the length of the frame members 40, are held in place by tangs 172 extending rearwardly from the backside of the buffers 170 through a vertically elongate opening 174 formed in and extending along the length of the central portion 176 of the forward wall 56. The tangs 172 have transversely extending hooked free end portions 178 which overlap the backside of the central wall portion 176. The tangs 172 are sufficiently resilient to flex so that the hooked ends 178 of tangs 172 may be engaged through the central wall opening 174 and then sprung back to their nominal positions to capture the central wall portion 176 between the back side of the compression buffers and the tang hooked ends 178. The compression buffers 170 also include spaced apart lugs 180 that extend rearwardly from the upper and lower portions of the buffers to snugly engage within the vertically extending wall opening 174. Ideally, the width of the lugs 180 closely corresponds to the width of the wall opening 174 to prevent the buffer from moving in the sideways direction within the opening.

It will be appreciated that as a result of the foregoing construction, the compression buffers 170 may be conveniently and readily installed on the frame member 40 by simply aligning the compression buffers with the central wall opening 174 and then pushing the buffers toward the opening so that first the lugs 180 and then the tangs 172 extend into the opening. As the tangs 172 pass through the openings the sloped rearward edges 182 of the hooked ends 178 of the tangs slide against the side edges of the opening 174. Once the tangs have passed through the opening 174, the tangs return to their nominal position whereby the hooked ends 182 of the tang overlap the back surface of the central wall portion 176 adjacent the opening 174. Moreover, the compression buffers are securely held in place by the tangs 172 as well as being positioned by the lugs 180. Also, it will be appreciated that the lugs 180 serve to conveniently prealign the buffers with a corresponding opening 174 before engagement of the tangs 172 through the opening. Once engaged within the vertical opening 174, the compression buffers are restrained from sliding vertically along the opening by staking the wall portion 176 outwardly at locations just above and below the compression buffers so as to overlap the upper and lower ends of the compression buffers.

As illustrated in FIGS. 5–9, the upper and lower corners of the compression buffers 170 are beveled at 184 to facilitate the sliding of the compression buffers over each other as the vertical frame members 40 are being coupled together. Also, as most clearly shown in FIGS. 3, 4 and 9, a longitudinal ridge 186 extends along one side of the face of the compression buffers and a longitudinal groove 188 extends along the opposite side of the face of the compression buffers. Ideally, the ridge 186 and the groove 188 are V-shaped in cross section and are sized and positioned relative to each other so that the ridge 186 of one compression buffer snugly engages within the groove 188 of the mating face-to-face compression buffer of the adjacent wall panel.

The compression buffers 170 may be composed of any appropriate material that is resiliently compressible and of sufficient structural integrity to withstand the loading on the compression blocks as they are slid relative to each other and simultaneously compressed when the vertical members 40 are coupled together. Examples of such materials include, for instance, thermoplastic polyester such as Dupont Hytrel TM, thermoplastic polyurethane such as sold under the trademark Santaprene TM and thermoplastic rubber such as Koraseal by B. F. Goodrich.

When the adjacent frame vertical members 40 are coupled together, the compression buffers pushing against each other, securely load the cam latches 126 against mating cross pins 128. Also, the engagement of the ridges 186 and grooves 188 with corresponding grooves 188 and ridges 186 of mating compression buffers 170, as well as the close side-to-side overlap between the sides of the compression buffers and the flange 158 of an adjacent panel, restrain the coupled vertical frame members 40 against any appreciable transverse (side-to-side) movement, thereby assisting in stabilizing the wall panel system of the present invention.

Figure 9:
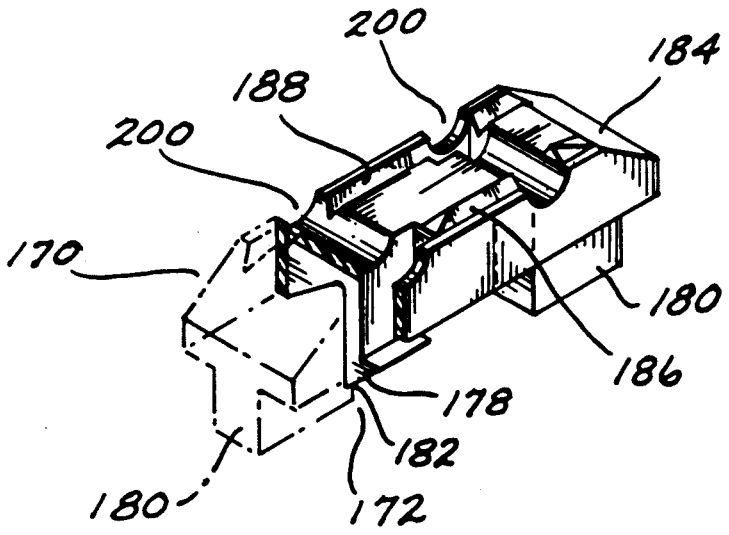
FIG. 9 is an enlarged isometric view of a compression buffer that contributes to the rigid coupling of the wall panels of the present invention, with portions broken away for clarity.

Once the frame members 40 have been coupled together, they may be locked together to restrain relative vertical movement by a U-shaped bail 190 which extends through aligned cross holes 192 and 194 formed in the flanges 156 and 158 and through one of the two cross holes 196 and 198 formed in the cam latch 126 which is in mating engagement with a cross pin 128 spanning between the flanges 156 and 158, FIGS. 2 and 5–8. Preferably the tynes of the bail are of sufficient length to also extend across the compression blocks 170 to engage through the aligned cross holes of the flanges 158 and 156 of the mating vertical member 40, which flanges are located on the opposite side of the compression blocks 170. One of the tynes of the bail also extends through one of the two cross holes 196 and 198 formed in the cam latch 126 of the mating vertical frame member 40. As perhaps most clearly illustrated in FIGS. 6 and 8, if one of the tynes of the bail 190 extends through the lower cross hole 198 of the cam latch 126, the other tynes extends through the upper cross-hole 196 of the cam latch disposed on the opposite side of the compression buffers 170, and vice versa. As shown in FIGS. 3, 5, and 9 cross slots 200 extend transversely across the compression buffers 170 in alignment with cross holes 192 and 194 to provide clearance for the tynes of the bail 190. It will also be appreciated that the cross holes 196 and 198 are located along the length of the cam latches 126 so that one of the two cross holes is in alignment with either the flange cross hole 192 or 194 when the cam latch 126 is in engagement with its mating cross pin 128.

To assemble adjacent wall panels together, for instance wall panels 14 and 16, the two wall panels are simply placed in edge-to-edge alignment to engage the cam latches 126 within corresponding channels 162 associated with the cross pin 128 of the opposite panel. During the insertion of the cam latches 126 into the corresponding channels 162, one of the panels is raised upwardly relative to the other panel a sufficient distance so that the bottom of the cam latch 126 of such panel is above the elevation of the corresponding cross pin of the other panel. For instance, in FIGS. 1 and 5, the panel 16 is raised upwardly relative to panel 14 so that the bottom of the cam latch 126 mounted on the panel 16 is above the cross pin 128 mounted on the panel 14. It will be appreciated that in this relative positioning of the two panels, the cam latch 126 of the panel 16 is disposed downwardly relative to its retaining pins 150*a* and 150*b* so that the upper retaining pin 150*a* abuts against the upper end of the slot 148 formed in the cam latch. To complete the coupling of the panels 14 and 16, the panel 16 is simply lowered into place so that the caming surface 136 of the cam latch 126 passes along the cross pin 128 until the cross pin is seated within the lower stop 138*b* and the cam latch slides relative to its mounting pins 150*a* and 150*b* until the lower pin 150*b* abuts against the bottom end of the slot 148. It will be appreciated that simultaneously the cross pin 128 mounted on the panel 16 passes downwardly along the caming surface 136 of the cam latch 126 mounted on the panel 14 until the cross pin has seated within the upper stop 138*a* of the cam latch and the cam latch has shifted longitudinally so that its upper mounting pin 150*a* abuts the end of the slot 148. As the panel 16 is lowered relative to the panel 14, the associated compression buffers 170 of the panels initially engage each other at their beveled ends 184 and then slide over each other along their faces 186 whereupon the compression buffers react against each other to generate a force in opposition to the engagement of the cam latches 126 with corresponding cross pins 128. When the cam latches 126 are fully engaged with corresponding pins 128, ideally the mating compression buffers 170 of the adjacent wall panels are in face-to-face relationship to each other, as shown in FIG. 6. It will be appreciated that the compression buffers 170 when engaged against each other play an important part in providing a tight, rattle free coupling between the wall panels 14 and 16.

As shown in FIG. 6, when the cam latch 126 of the panels 16 and 14 are engaged with mating cross pins, the cam latch mounted on the panel 16 is positioned at an elevation above the cam latch mounted on the panel 14 since the lower stop 138*b* of the cam latch 126 of the panel 16 is engaged with its mating cross pin whereas the upper stop 138*a* of the cam latch 126 of the panel 14 is engaged with its mating cross pin 128, and the two cross pins are in alignment with each other. It also will be appreciated that if one or both of the panels 14 or 16 are reversed so that their opposite side edges are abutted together, the two panels may be simply recoupled together in the same manner as described above.

Moreover, as shown in FIGS. 7 and 8, the panels 14 and 16 may be coupled together by lowering panel 14 relative to panel 16 rather than lowering the panel 16 in the manner described above. In this situation, the lower stop 138*b* of the cam latch 126 mounted on the panel 14 is engaged with the mating cross pin 128 of the panel 16. Conversely, the upper stop 138*a* of the cam latch 126 mounted on the panel 16 is seated with its mating cross pin 128 mounted on the panel 14.

Once the panels are coupled together, the locking bail 190 may be inserted through the flange openings 192 and 194 as well as through one of the the cross holes 196 and 198 of each of the cam latches, thereby to prevent relative vertical movement of the panels 14 and 16. To disassemble the panels, the foregoing procedure is simply reversed.

It will be appreciated that a plurality of sets of cam latches 126 and cross pins 128 may be mounted on wall panels in spaced apart relationship to each other, with the number of such sets depending on various factors such as the height of the panel, the length of the panel, the weight of the panel, etc. Also, if desired, the cam latch and cross pin sets may be located along the height of the panel edges so that if a panel is flipped upside down (about a horizontal axis so that the bottom of the panel is now the top of the panel), the reoriented panel may be simply recoupled to its adjacent panel in the same manner described above. Also, the sets of cam latches 126 and cross pins 128 are positioned along the height of the panel at standard locations so that it is possible to couple together wall panels of different height combinations, for instance, a 48 inch high wall panel coupled to a 76 inch high wall panel which in turn is coupled to a 30 inch high wall panel, etc. Thus, it will be appreciated that the coupling system of the present invention provides maximum flexibility in the manner in which the panels to be coupled together may be oriented relative to each other without requiring any modifications or alterations of the panels nor requiring any hardware members (such as threaded fasteners), clips or similar devices to be installed to rejoin the panels together.

Although not specifically illustrated, it is to be understood that the sides of the corner connection posts 20 facing the adjacent edges of the panels 16 and 18 are constructed similarly to the adjacent edges of the panels. As such, the connection post may be coupled with the panels 16 and 18 in the same manner in which such panels may be coupled together in edge-to-edge relationship, as discussed above. Moreover, connection posts of other configurations, such as in "L", "T" and "X" configurations, may be provided to interconnect two, three and four panels, respectively, of the present invention. In a "L" type of connector post, two of the sides of the post would be shaped and constructed in the manner of the forward walls 56 of the vertical frame members 40, in a "T" type of connector post three of the sides of the post would be shaped and constructed in the manner of the forward walls 56 of the vertical frame members 40, whereas in a "X" type connector post, all four sides of the connector post would be configured in the manner of the forward wall 56 of the frame vertical members 40.

Figure 11:
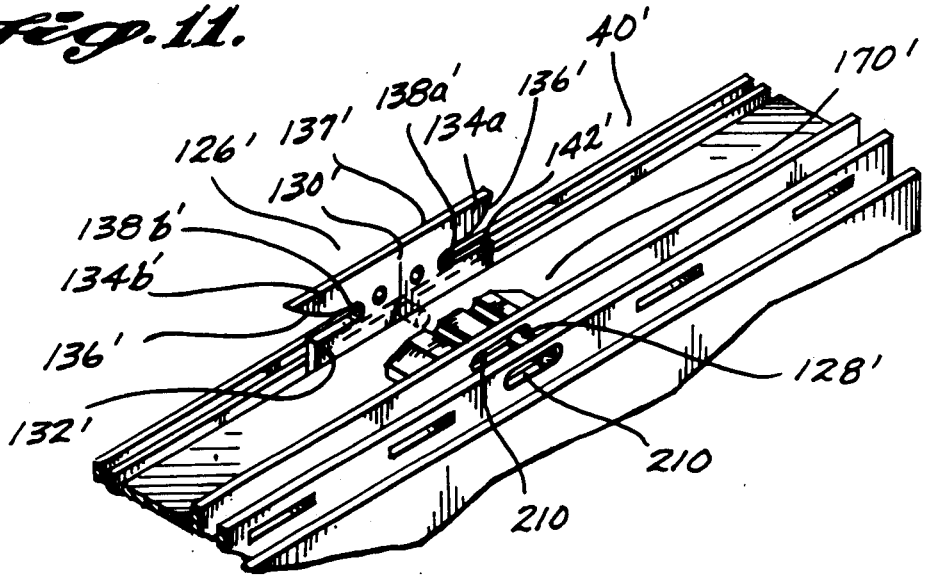
FIG. 11 is a fragmentary isometric view of an edge portion of a wall panel illustrating an alternative preferred embodiment of the present invention.

An alternative construction of the present invention is shown in FIG. 11, which illustrates a portion of a vertical frame member 40' which is constructed similarly to vertical member 40 described above, but with the forward wall 56' configured so that the cam latch 126' is mounted in fixed location and the cross pin 128' is permitted to slide within aligned slots 210 formed in flanges 156' and 158'. The cam latch 126' may be constructed as an independent member and then secured to the forward wall 56' of the vertical frame member 40' by any convenient means, for instance, by fasteners (not shown), or weldments (not shown). Alternatively, the cam latch 126' may be integrally constructed with the forward wall 56', e.g., manufactured as part of a singular unit with the forward wall 56', for instance, by extrusion, machining or stamping. The slots 210 are sufficient length to enable the cross pin 128' to shift or slide along the slots a distance corresponding to the longitudinal distance separating the cam latch stops 138*a'* and 138*b'*.

As such, when the cross pin 128' is disposed at one end of the slots 210, the cross pin is in alignment with stop 138a', and when the cross pin is disposed at the opposite end of the slots 210, the cross pin is aligned with cam latch stop 138b'. It will be appreciated that with the exception of foregoing modifications, the vertical frame member 40' is of the same construction as the vertical frame members 40 discussed above. As such, the vertical frame members 40' may be interconnected together in the same manner as the vertical frame members 40, discussed above, and provide the same advantages as provided by the vertical frame members 40, discussed above.

Figure 13:
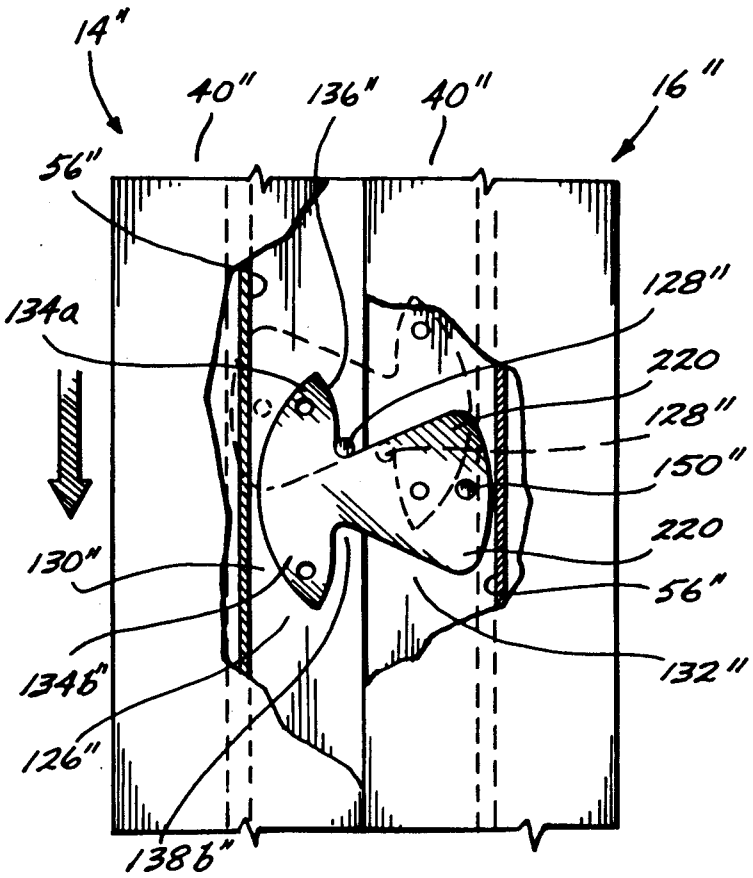
FIG. 13 is a view similar to FIG. 12, but with the two wall panels shown in interconnected condition.
Figure 12:
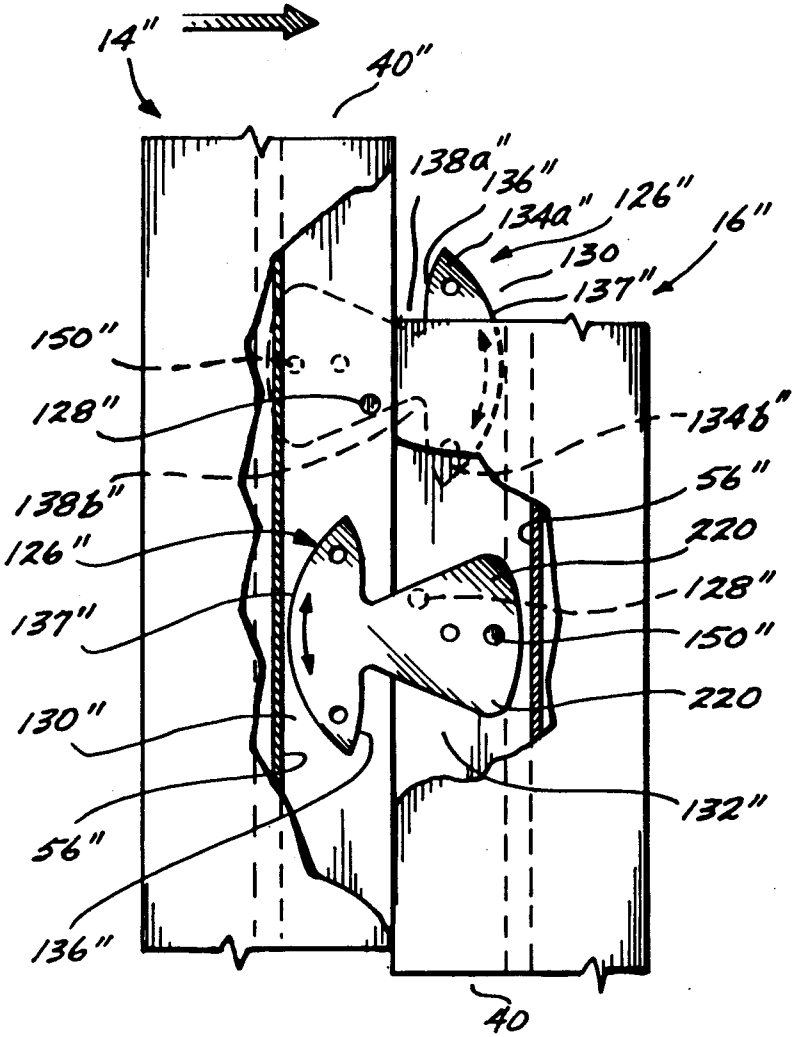
FIG. 12 is a fragmentary side elevational view of two wall panels constructed in accordance with a further preferred embodiment of the present invention prior to the interconnection of the two panels.

A further alternative preferred embodiment of the present invention is shown in FIGS. 12 and 13 which illustrate another connection system for interconnecting panels 14" and 16". The components of panels 14" and 16" which are similar or correspond to the components of panels 14 and 16 shown in FIGS. 1–8 above are represented by the same part number but with a double prime (") designation. Rather than utilizing a sliding cam latch similar to cam latch 126 discussed above, in the embodiment shown in FIGS. 12 and 13, the hermaprodic coupling system includes sets of pivoting cam latches 126" and catches in the form of cross pins 128" mounted on the forward walls 56" of the vertical frame members 40". The cam latch 126" and cross pin 128" of each set are disposed in side-by-side relationship to each other in the manner described above with respect to the cam latches 126 and cross pins 128, to engage with mating cross pins 128" and cam latches 126", respectively, mounted on the abutting frame vertical member 40" of the adjacent wall panel.

The cam latches 126" are generally planar and include a forwardly extending hook section 130" and the rearwardly disposed shank section 132". As in hook section 130 of cam latch 126, the hook section 130" is composed is a pair of opposing, spaced apart hooks 134a" and 134b" defined by contoured caming surfaces 136" that extend from the ends of the leading edge 137" of the hook section toward the longitudinal center of the cam and also simultaneously rearward toward the shank section 132" of the cam latch (thus in the direction away from the panel that is adjacent to the panel in which the cam latch is mounted). The caming surface 136" terminates at stops or seats 138a" and 138b" which may be spaced apart from each other the same distance as stops 138a and 138b, discussed above.

The shank section 132" of the cam latch 136" is generally triangular in shape and extends transversely to the length of the hook section 130". The shank section 132" is pivotally mounted on the vertical frame member 40" by a cross pin 150" extending through a clearance cross hole formed in the shank section. The angle through which the cam latch 126" is allowed to pivot about the pin 150" is limited by the abutment of the corners 220 of the shank section 132" against the forward surface of forward wall 56". As such, a gap always exists between the caming surface 136" of the cam latch and the forwardmost edge of the corresponding frame vertical member 40" so as to receive a mating cross pin 128" along the contoured caming surfaces 136" of the hook section 130".

The operation of the cam latch 136" is essentially in the same manner as the cam latch 136, discussed above, but with the exception that the cam latch 136" pivots about mounting pin 150" rather than sliding longitudinally in the manner of the cam latch 136. As a result, when the wall panels 14" and 16" are engaged together by lowering the wall panel 14" downwardly relative to the wall panel 16", the cross pin 128" of the wall panel 14" is engaged against the upper stop 138a" of the cam latch 126" mounted on the wall panel 16", FIG. 13. Although not shown, it will be appreciated that if the wall panels 14" and 16" were assembled together by lowering the wall panel 16" relative to the wall panel 14", the cross pin 128" of the wall panel 14" shown in FIG. 13, would be engaged against the lower stop 138b" of the cam latch 126". The pivoting movement of the cam latch 126" makes it possible for the cross pin 128" to seat against either the stop 138a" or the stop 138b" depending upon the relative direction of movement of the panels 14" and 16" when coupled together. As a result, the cam latches 126" and cross pin 128" provide the same advantages as provided by the cam latch 126 and mating cross pin 128, discussed above. It will be appreciated that with the exception of the foregoing modifications, the wall panels 14" and 16" are essentially of the same construction as the wall panels 14 and 16, discussed above.

Figure 15:
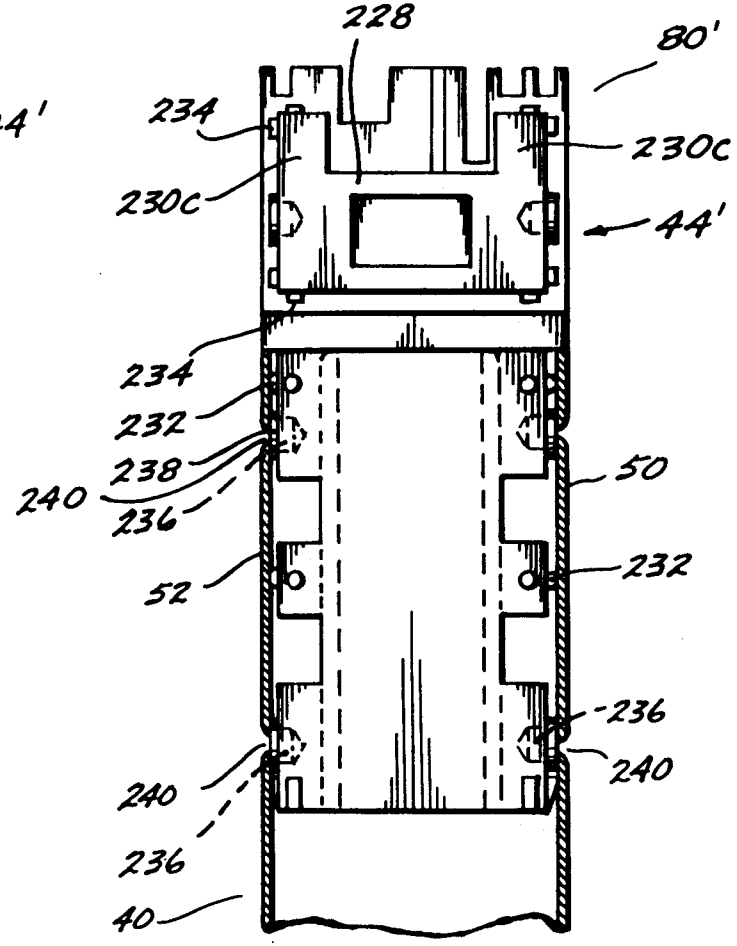
Figure 14:
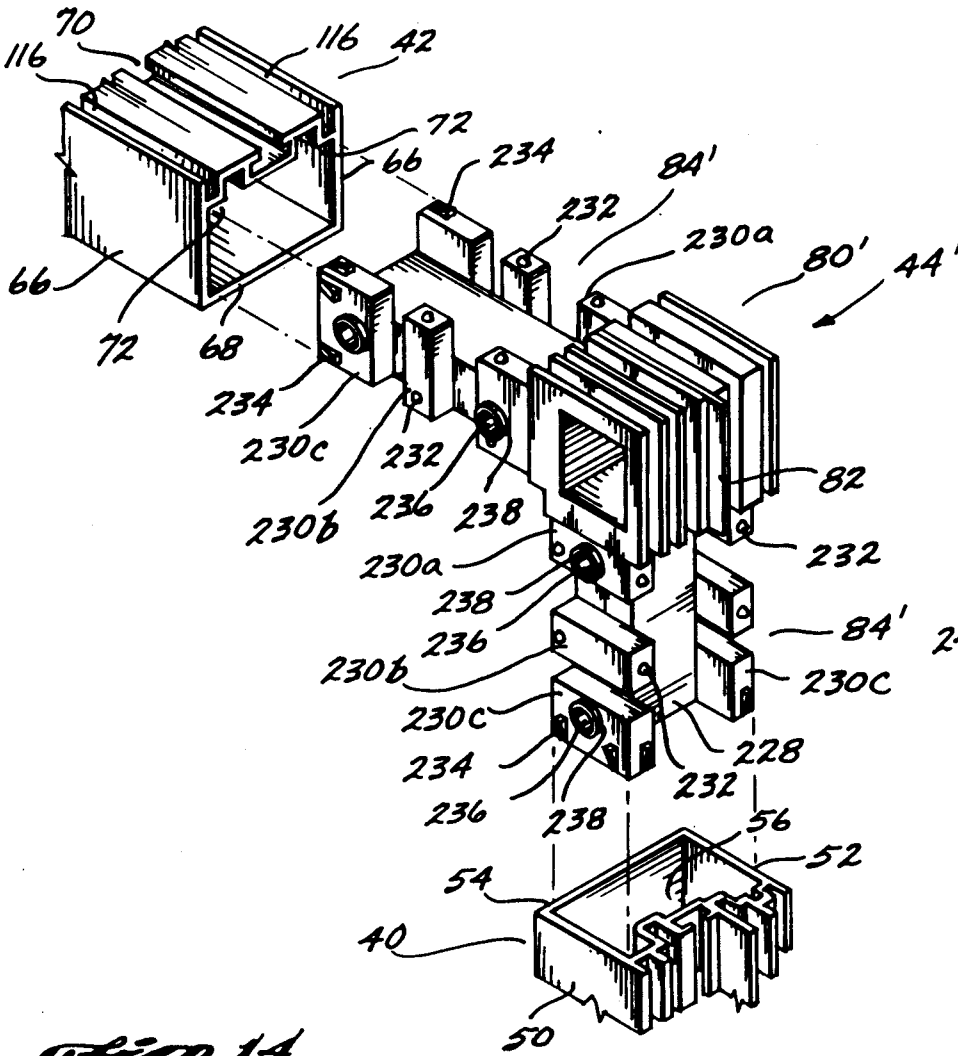
FIG. 14 is a fragmentary isometric view illustrating an alternative preferred embodiment of a corner connector used to interconnect the ends of the frame members of a panel; and, FIG. 15 is an enlarged, fragmentary elevational view illustrating the corner connector of FIG. 14 engaged with a frame member of a panel, with portions of the frame member broken away for clarity.

FIGS. 14 and 15 illustrate an alternative preferred corner connector embodiment. In these figures, the portions of the corner connector 44' illustrated which correspond to portions of the corner connector 44 best shown in FIGS. 2 and 10, are designated by the same number but with the addition of a prime "'". Two legs 84' extend outwardly from a central portion 80' of the corner connector 44' in directions transversely to each other. The legs 84' are constructed with a longitudinal central core 228 and a plurality of cross flange portions 230a, 230b and 230c extending adjacent the sidewall 66 of the top frame 42 and the sidewalls 50 and 52 of the framed vertical members 40. A plurality of spaced apart projections or buttons 232 extend transversely outwardly from the exterior surfaces of the cross flanges 230a and 230b to define a maximum exterior profile somewhat larger than the interior envelope of the frame members 40, 42 and 44. Consequently, in order to connect the frame members 40, 42 and 46, the legs 84' of the corner connectors 44' must be forged into the interiors of the frame members. As this occurs, the outermost portions of the concave shaped buttons 232 are sheared so that the buttons are very snugly engaged within the interiors of the frame members.

As also shown in FIGS. 14 and 15 a plurality of ramp fins 234 are located on the cross flanges 230c at the distal or free ends of the connector legs 84'. At their leading ends, the ramp pins 234 are coplanar with the exterior surface of the connector leg flanges 230 and extend diagonally outwardly from the flanges 230c in the direction towards the central portion 80' of the corner connector 44'. As the corner connector is assembled with the frame members, the leading ends of the ramp fins 234 engage within the hollow interior of the frame members to guide and "center" the legs 84' of the corner connector during the initial engagement into the frame members. However, as legs 84' are pushed further into the frame members, the profile defined by the outer surface of the ramp fins increase in size and eventually becomes larger than the interior envelope of the frame members 40, 42 and 46. Consequently, in order to fully engage the corner connector 44' into the frame members, the outer edges of the ramp fins 234 are sheared by the sharp corners defined by the interior surfaces of the frame members and the end edges of the frame members.

It will be appreciated that the interference between the projections 232 and ramp fins 234 with the interior of the frame members 40, 42 and 44 results in a very secure, snug fit of the corner connector 44' within the frame members. As such, the corner connector 80' serves to enhance the structural integrity and rigidity of the perimeter frames 22, 24 and 26. Moreover, the corner connector 44' of the present invention is configured to provide an additional method of retaining the corner connector securely and rigidly engaged with the frame members. To this end, a plurality of apertures or cross holes are formed in the portions of the flanges 230 and 230*c* corresponding to the sidewalls 66 of the top frame member 42 and sidewalls 50 and 52 of the frame vertical members 40. The cross holes 236 are defined by the interiors of raised bosses 238 extending around the cross holes. Ideally the bosses extend outwardly from the surface of the flanges 230*a* and 230*b* to closely engage within the interiors of the frame members 40, 42 and 46, but not so far so as to create an interference fit with the interiors of the frame member. The bosses enhance the structural integrity of the flanges 230*a* and 230*b* adjacent the location of the cross holes 236. Once the corner connector 44' has been engaged with the ends of the frame members, the sidewall portions of the frame members that are aligned with the cross holes 236 may be staked or otherwise deformed at 240 into the cross holes 236. As will be appreciated, the raised bosses 238 help assure that the portions of the corner connector surrounding the cross holes 236 do not distort during the staking process.

It will be understood that a fewer or greater number of cross flanges may be utilized than shown in FIGS. 14 and 15. Also, the number and locations of the buttons 232, ramp fins 234 and cross holes 236 may be varied without departing from the scope of the present invention.

The present invention has been described in relation to several preferred embodiments. One of ordinary skill after reading the foregoing specification may be able to make various other changes, alterations, and substitutions or equivalents without departing from the broad concepts disclosed. It is therefore intended that the scope of the Letters Patent granted herein be limited only by the definitions contained in the appended claims and the equivalents thereof.

The embodiments of the invention in which an exclusive property or privilege is claimed are defined as follows:

1. A system for detachably connecting a first member and a second member, comprising:

(a) a longitudinal coupling set, comprising a cam latch and an associated catch, mounted on each of the first and second members for mating the first and second members, with the cam latch and catch of each coupling set disposed in side-by-side relationship to each other so that the cam latch of the first member is engageable with the catch of the mating coupling set of the second member and the catch of the first member is engagable with the cam latch of the mating coupling set of the second member;

(b) means for mounting the coupling sets on the first and second members to permit relative shifting between the cam latch and associated catch of a coupling set a fixed distance along the member on which the coupling set is mounted; and (c) the cam latch mounted on each of the first and second members comprising a pair of spaced apart caming surfaces formed by the cam latch, the caming surfaces extending longitudinally along the cam latch and terminating at a pair of corresponding, longitudinally spaced apart, stops formed in the cam latch, one of the caming surfaces of each pair of caming surfaces engagable with the mating catch mounted on the opposite member, the longitudinal distance separating the stops of the cam latch of each coupling set corresponding to the longitudinal distance the cam latch and associated catch of that coupling set are permitted to shift relative to each other.

2. The system according to claim 1, wherein at the location of maximum relative movement between the cam latch and associated catch of a coupling set in a first direction, the catch is in abutment with one of the stops of the mating cam latch and at a maximum relative movement between the cam latch and associated catch of a coupling set in the second, opposite direction, the catch is in abutment with the opposite stop of the mating cam latch.

3. The system according to claim 1, wherein the means for mounting the coupling sets on the members permit the cam latch and associated catch of a set to slide relative to each other a fixed distance along the member on which the coupling set is mounted.

4. The system according to claim 3, wherein the mounting means comprises means for stationarily mounting the catch and slidably mounting the cam latch for movement along the length of the member on which the coupling set is mounted.

5. The system according to claim 4, wherein at the location of maximum travel of the cam latch in a first direction, the mating catch of the opposite member is engaged with one of the stops of the cam latch, and at the location of maximum travel of the cam latch in a second, opposite direction, the mating catch is engaged with the second, opposite stop of the cam latch.

6. The system according to claim 1, wherein the stops of the cam latch comprise slots formed at the end of the corresponding caming surfaces.

7. The system according to claim 1, further comprising side abutments included on the first and second members and disposed adjacent the catch of each coupling set to limit the relative movement of a mating cam latch and catch in a direction laterally to the longitudinal length of the members being connected.

8. The system according to claim 7, wherein the side abutments comprise a groove formed in and extending longitudinally of the member on which the catch is mounted for slidably receiving the mating cam latch.

9. The system of claim 1, further comprising loading means for imposing a force on the first and second members being connected in a direction away from each other and in opposition to the engaged cam latch and mating catch.

10. The system according to claim 9, wherein the loading means comprise resilient, compressible means mounted on the first and second members being interconnected.

11. The system according to claim 10, wherein the resilient compressible means are disposed between the cam latch and catch of each coupling set.

12. The system according to claim 10, wherein the resilient, compressible means comprise compression buffers mounted on each of the first and second members being interconnected to exert a force on the opposite member in a direction tending to force the members away from each other.

13. A connection system for interconnecting wall panels of corresponding construction to form walls of predetermined sizes and orientation, the wall panels being generally rectangular in shape and having opposed vertical side edges, opposed horizontal edges and opposed vertical faces, the connection system comprising:

(a) at least one coupling set, comprising a cam latch and an associated catch, mounted at the side edge of each panel for mating the panels, the cam latch of the coupling set of one panel being engagable with the catch of the mating coupling set of an adjacent panel and the catch of the coupling set of one panel being engagable with the cam latch of the mating coupling set of the adjacent panel;

(b) means for mounting the coupling sets on the side edge of each panel with the cam latch and associated catch of each coupling set being disposed in side-by-side relationship to each other to permit relative movement between the cam latch and associated catch of the coupling set along the panel side edge on which the coupling set is mounted; and, (c) the cam latch of each coupling set being longitudinal and forming a pair of spaced apart caming surfaces extending longitudinally along the cam latch and inward relative to the corresponding vertical side edge of the panel on which the cam latch is mounted to terminate at a pair of corresponding, spaced apart stops formed in the cam latch, one of the stops being engagable with a mating catch of an adjacent panel when the cam latch and associated catch of a coupling set are shifted relative to each other in one extreme location and the other of the stops being engagable with a mating catch of an adjacent panel when the cam latch and associated catch of a coupling set are shifted relative to each other in the opposite extreme location.

14. The connection system according to claim 13, wherein the longitudinal distance separating the stops of a cam latch corresponds to the longitudinal distance that the cam latch and associated catch are permitted to move relative to each other.

15. The connection system according to claim 13, wherein the means for mounting the coupling sets on the panel side edges permit the cam latch and associated catch of a coupling set to slide relative to each other a fixed distance along the length of the panel side edge on which the coupling set is mounted.

16. The connection system according to claim 15, wherein the mounting means comprises means for stationarily mounting the catch and slidably mounting the cam latch for movement along the length of the wall panel side edge on which the coupling set is mounted.

17. The connection system according to claim 16, wherein at the location of maximum travel of the cam latch in a first direction, the mating catch of the adjacent panel is engaged with one of the stops of the cam latch, and at the location of maximum travel of the cam latch in the opposite direction, the mating catch is engaged with the second, opposite stop of the cam latch.

18. The connection system according to claim 13, wherein the stops of the cam latch comprise slots formed at the end of the corresponding caming surfaces.

19. The connection system according to claim 13, further comprising lateral restraining means adjacent to the catch to resist the relative movement of a mating cam latch and catch in a direction laterally of the length of the longitudinal caming surfaces.

20. The connection system according to claim 19, wherein the lateral restraining means comprise a channel formed in and extending longitudinally of the panel side edge for slidably receiving the mating cam latch.

21. The connection system according to claim 13, further comprising buffer means for imposing a load on the wall panels being interconnected in a direction tending to separate adjacent side edges of the panel from each other in opposition to the engaged cam latch and mating catch.

22. The connection system according to claim 21, wherein the buffer means comprise resilient, compressible means mounted on the side edges of the panels being interconnected.

23. The connection system according to claim 13, further comprising flange means extending laterally from the side edge of the wall panels towards the side edge of the adjacent wall panels to diminish the passage of light at the intersection between the two adjacent wall panels.

24. A wall panel comprising:

(a) a perimeter frame extending around the wall panel, the perimeter frame having upright frame members extending along the side edges of the wall panel and top and bottom frame members extending along the top and bottom edges of the wall panel;

(b) connection means for securely detachably interconnecting the wall panel to an adjacent attachment member selected from the group consisting of a junction post and an adjacent panel, in edge-to-edge relationship to each other, the connection means comprising at least one coupling set, comprising a double-hook and a catch, associated with a frame upright member and at least one coupling set, comprising a double-hook and a catch, associated with the attachment member, the double-hook and catch of each coupling set mounted on the frame upright member, disposed generally in side-by-side relationship to each other and disposed in registry with a mating catch and double-hook, respectively, of a mating coupling set mounted in side-by-side relationship on the attachment member;

(c) means for mounting the coupling sets on the frame upright member and attachment member to permit relative shifting between the double hook-and catch of a coupling set along the upright member and attachment member, respectively, on which the coupling set is mounted; and, (d) wherein each double-hook includes longitudinally spaced-apart first and second hooks each terminating at a seat formed in the double-hook, each seat being capable of receiving a mating catch, the two seats of the first and second hooks being spaced apart from each other a distance corresponding to the distance that the double hook and catch of a coupling set are permitted to shift relative to each other so that regardless of whether the mating catch of the mating coupling set is engaged with the first or second hook of the double hook, the vertical position of the wall panel relative to the adjacent attachment member remains the same when interconnected together.

25. The wall panel according to claim 24, wherein the mounting means mount the coupling sets on the frame upright member and on the attachment member to permit relative sliding between the double-hook and associated catch of a coupling set along the heights of the upright member and attachment member, respectively.

26. The wall panel according to claim 25, wherein the mounting means includes means for maintaining the catch of each coupling set stationary and mounting the associated double-hook to slide relative to the associated catch a distance corresponding to the distance separating the two seats of the double-hook.

27. The wall panel according to claim 24, wherein each hook includes an elongate caming surface extending generally longitudinally relative to the lengths of the upright frame member and the attachment member and inwardly away from the mating catch to draw the panel and the adjacent attachment member towards each other as the mating coupling sets are engaged.

28. The wall panel according to claim 26, wherein the connection means comprises a hook plate contoured to define both hooks of the double-hook as well as the corresponding caming surfaces and seats.

29. The wall panel according to claim 28, wherein:

the hook plate includes a longitudinal slot extending along the hook plate in the direction corresponding to the height of the upright member; and, the connection means further comprises pin means anchored to the upright frame member and extending through the hook plate slot to retain the hook plate on the upright member and permit the hook plate to slide longitudinally along the height of the upright member.

30. The wall panel according to claim 24, wherein:

the upright frame members and top and bottom frame members each have hollow end portions; and, further comprising corner connection means for interconnecting the ends of the upright members with the adjacent ends of the top and bottom members, the corner connection means comprising:

a central member and leg members extending outwardly from the central member to engage within the hollow ends of the corresponding frame members; and, a plurality of shearable means extending transversely outwardly from the leg members to define a maximum profile in the direction transversely of the leg members of a size somewhat larger than the transverse profile of the hollow interior of the end portions of corresponding frame members whereupon engagement of the leg members into the hollow interior of the corresponding frame members results in a shearing of the shearable means.

31. The wall panel according to claim 30, wherein the shearable means include a plurality of shear fins extending transversely outwardly from the leg members to terminate at outer edge portions that define a maximum profile of a size larger than the transverse profile of the hollow interior of the end portions of corresponding frame members whereupon engagement of the leg members into the hollow interior of the corresponding frame members results in a shearing of the outward edge portions of the shear fins.

32. The wall panel according to claim 30, wherein the shearable means includes a plurality of spaced apart shear buttons having a generally convex exterior shape projecting transversely outwardly from the leg members to define a maximum profile in the direction transversely to the leg members of a size somewhat larger than the transverse profile of the hollow interior of the end portions of corresponding frame members.

33. The wall panel according to claim 32, wherein the shearable means further includes a plurality of beveled shear fins extending outwardly from the leg members at locations distal from the central member to engage within the hollow ends of corresponding frame members as the leg members initially engage within the frame members, the beveled fins having leading portions disposed towards the free ends of the leg members and trailing portions disposed towards the central member, the leading portions of the beveled fins defining a maximum profile of a size somewhat smaller than the transverse profile of the hollow interior of the end portions of corresponding frame members and the trailing portions of the beveled fins defining a maximum profile somewhat larger than the transverse profile of the hollow interior of the end portions of corresponding frame members.

34. The wall panel according to claim 33, wherein the corner connection means further comprising transverse apertures formed on the exterior of the leg members for reception of adjacent portions of the frame members deformed into the apertures after engagement of the corner connection means with the corresponding frame members.

35. The wall panel according to claim 24, further comprising stabilizing means to limit the relative lateral movement between the wall panel and adjacent attachment member when interconnected together.

36. The wall panel according to claim 35, wherein the stabilizing means includes side abutments formed on the wall panel for receiving a mating double-hook of an adjacent attachment member therein and further includes side abutments formed on the adjacent attachment member for receiving a mating double-hook of the wall panel therein, thereby to limit the relative movement between the wall panel and the adjacent attachment member.

37. The wall panel according to claim 24, further comprising biasing means for imposing a load on the wall panel and adjacent attachment member in a direction tending to separate the wall panel and adjacent attachment member from each other.

38. The wall panel according to claim 37, wherein the biasing means comprise resilient, compressible means which are activated upon connection of the wall panel to the adjacent attachment member.

39. The wall panel according to claim 37, further comprising stabilizing means to limit the relative lateral movement between the wall panel and adjacent attachment member when interconnected together.

40. The wall panel according to claim 39, wherein the stabilizing means includes flange means extending outwardly from an upright frame member to extend closely along biasing means mounted on the adjacent attachment member to limit the relative movement between the flange means and the biasing means.

* * * * *

UNITED STATES PATENT AND TRADEMARK OFFICE

CERTIFICATE OF CORRECTION

PATENT NO. : 5,054,255

DATED : October 8, 1991

INVENTOR(S) : H. E. Maninfior

It is certified that error appears in the above-identified patent and that said Letters Patent is hereby corrected as shown below:

| COLUMN | LINE | ERROR |
|---|---|---|
| 15 | 59 | "engageable" should be --engagable-- |
| (Claim 1, | Line 9) | |
| 19 | 20 | "Claim 26" should be --Claim 27-- |
| (Claim 28, | Line 1) | |

Signed and Sealed this

Ninth Day of March, 1993

*Attest:*

STEPHEN G. KUNIN

*Attesting Officer*

*Acting Commissioner of Patents and Trademarks*